United States Patent [19]

Pearson

[11] 4,107,463

[45] Aug. 15, 1978

[54] STEREOPHONIC NOISE SUPPRESSION SYSTEM

[76] Inventor: Edward E. Pearson, 220 Highland Dr., Lafayette, La. 70506

[21] Appl. No.: 813,179

[22] Filed: Jul. 6, 1977

[51] Int. Cl.[2] ..... H04R 5/00

[52] U.S. Cl. ..... 179/1 G

[58] Field of Search ..... 179/1 G, 1 GQ, 15 BT, 179/100.4 ST, 100.1 TD; 325/36

[56] References Cited

U.S. PATENT DOCUMENTS

| | | | |
|---|---|---|---|
| 3,539,729 | 11/1970 | von Recklinghausen | 179/15 BT |
| 3,823,268 | 7/1974 | Modafferi | 179/15 BT |
| 3,825,697 | 7/1974 | Cornell et al. | 179/15 BT |
| 3,943,293 | 3/1976 | Bailey | 179/1 G |
| 3,944,748 | 3/1976 | Kuhn | 179/15 BT |
| 4,029,906 | 6/1977 | Takahashi | 179/15 BT |

*Primary Examiner*—Douglas W. Olms
*Attorney, Agent, or Firm*—Laurence R. Brown

[57] ABSTRACT

Signal components of one stereo channel are transposed into the other channel dynamically as a function of stereo signal characteristics to cancel noise components. Thus, at low amplitudes monophonic output is produced at reduced noise levels and at higher amplitudes, the system reverts to stereophonic operation with a smooth transition from monophonic to stereo mode of operation. This system, for example, eliminates most vertical stylus motion noise caused by record groove surface flaws and by vibrations from the playback mechanism.

10 Claims, 2 Drawing Figures

STEREOPHONIC NOISE SUPPRESSION SYSTEM

This invention relates to stereophonic systems and more particularly it relates to reduction of noise distortion of stereophonic signals.

BACKGROUND OF THE INVENTION

It is recognized in the stereophonic art that more noise is intrinsically present than in monaural systems. Monaural phonograph records, for example, require groove modulation in a single plane and monaural phonograph cartridges may be constructed so as to attenuate output from stylus vibrations in other planes. Thus, monaural cartridges may reduce or eliminate noise from record surface flaws or other vibrations which induce stylus motion in planes other than that of the intended groove modulation. Additionally, hum cancelling phasing of coils may be effected.

Single-groove stereophonic, discs, however, are customarily modulated simultaneously in two perpendicular directions, usually 45° to the record surface. This results in lateral modulation representing the sum of the two stereophonic signals and vertical groove modulation representing the difference between the two signals. Stereophonic cartridges must, therefore, function in more than one plane and will respond to and produce outputs in the form of noise when vertical stylus motion is induced by record surface flaws, foreign material in record grooves, and vibrations from the playback mechanism. Such noise will appear in both channels with a phase difference between the channels of 180°.

Stereophonic FM broadcast signals are demodulated at approximately 20 db higher noise levels than equivalent monaural broadcasts. The intrinic characteristics of the multiplexing and subsequent demultiplexing process are such that the bulk of this additional noise appears in both channels with a phase difference between the channels of 180°. Most of this noise is moderately broadband ranging from approximately 1500 hz to 5000 hz and is audible as background hiss inversely proportional to the strength and proximity of the FM broadcast source.

In addition to predominately out-of-phase stereo noise sources, others are normally present which may be random in nature. Such noise may derive from passive components such as resistors, active components such as transistors, magnetic tape discontinuities, etc.

In consideration of the phase characteristics of the noise in stereo channels, it is apparent that elimination of the difference signal component, as measured between the channels, will reduce the noise content of the channels. Accordingly, some prior art FM receivers include provision for manually switching an impedance so as to partially intermix the stereo channels and cancel some noise at the expense of stereo separation.

Similarly, in prior art FM radio systems, reception may be switched from stereophonic to monaural reproduction automatically whenever the received signal strength falls below a threshold reception level of the 19 khz pilot subcarrier. In these systems, there is a sharp transition between stereo and monaural performance and available stereo program material is lost completely to reduce noise. These systems do nothing to reduce noise at signal strengths sufficient for stereophonic demodulation, but insufficient for full noise quieting.

Many prior art general application stereo noise suppressors maintain maximum stereo channel separation at all amplitudes and employ static and/or dynamic frequency responsive filters in each channel. Such devices are complex and expensive for applications requiring little degredation of original program material. Other prior art noise suppression systems employ combinations of expansion and compression and require, for effective results, that the dynamic range of the source material be altered prior to transmission or recording with subsequent restoration of the original dynamic range by additional equipment at the point of playback or reception. These systems are complex and require critical adjustments to preclude distortion of the original program material.

OBJECTS OF THE INVENTION

It is therefore a general object of the invention to improve the state of the foregoing prior art by reduction of noise in stereo signals.

Another object of the invention is to provide automatic controls responsive to signal characteristics for suppression of noise in stereophonic signals.

A further object of the invention is to suppress noise in stereo systems in such a manner that the stereo signal characteristics are little disturbed.

A more specific object of the invention is to reproduce low noise content stereophonic signals from embossed records.

BRIEF DESCRIPTION OF THE INVENTION

Therefore in accordance with this invention a transfer circuit is connected between two stereo channels to effect dynamic control of channel separation, thereby cancelling a proportional amount of the difference signal and included noise components. Control is effected as an automatic function of the signal content including amplitude and other elements such as frequency. In typical embodiments the stereo signal from two input channels is derived as a difference signal and this signal is analyzed to derive a variable correction signal which may control inter-channel signal or impedance. The control sense is such that for lowest amplitude signals, the signal interconnection between the channels is the greatest and channel separation is lowest, so that outputs are essentially monophonic. Preferably a smooth transition is afforded between monophonic and stereophonic operation so that an observer will not normally be aware of the transitions and so that a greater proportion of stereo signal is present as the proportion of noise in the signal decreases with greater signal strength. Manual controls may be included to afford selection of appropriate amplitude thresholds for maximum and minimum channel separation and selection of signal frequency parameters as they relate to the control function.

THE DRAWING

The foregoing and further objectives, features and advantages of the invention will be found throughout the following description, which makes reference to the accompanying drawing, wherein . . .

DETAILED DESCRIPTION OF THE INVENTION

Figure 1:
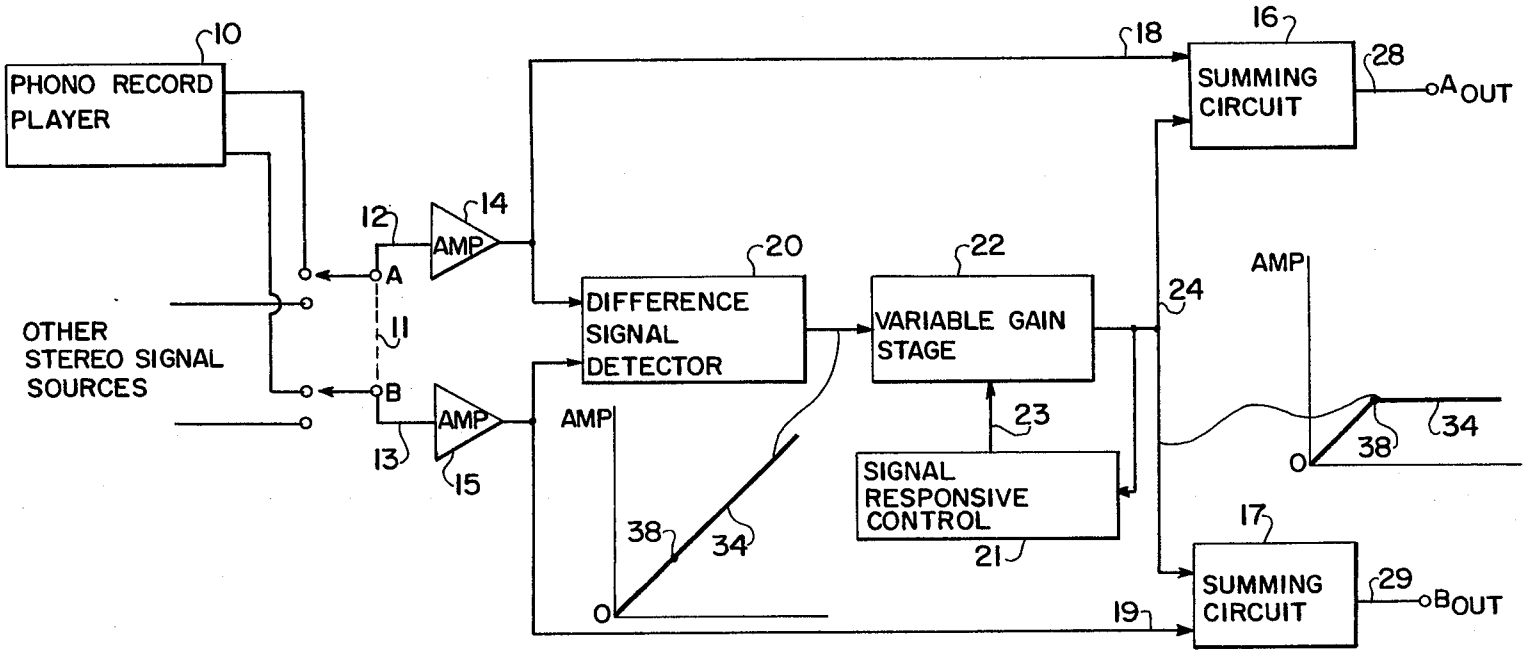
FIG. 1 is a block schematic diagram of a preferred embodiment of the stereophonic noise suppression system afforded by this invention.

As may be seen in the preferred embodiment of FIG. 1, stereo signals may be derived from a phono record player 10 or other signal source as selected by switch 11. Each source has two stereo channels 12, 13 amplified at 14, 15 and passed along separate channels to output amplifiers included in 16, 17. Signals in the two channels are respectively indicated A and B. Input signals encompass the audio frequency range and may include noise or other components in the sub-audio and ultrasonic frequency ranges. Channels A & B bear the conventional stereo relationship such that only signals in both channels of identical amplitude and phase are monophonic.

Channel separation of output signal voltages, as applicable to this invention, is defined in decibels as 20 log A/B with signal input to A and zero input to B, or as 20 log B/A with signal input to B and zero input to A. It is a measure of the amount of signal cross-coupled from one channel to the other. Normally, channel separation of approximately 20 db or greater is sufficient to fully realize the subjective stereophonic effect offered by the program material. As channel separation is reduced below approximately 10 db, the reproduction will be largely monophonic until all stereo effect is lost at zero db separation, where in-phase channel signals are averaged between the two channels and oppositely phased channel signals are either cancelled or attenuated. Thus, if two stereo channels are interconnected in any manner to effect zero db channel separation, monophonic input signal components will not be altered, however all noise and signal components present in both channels of equal magnitude but oppositely phased will be cancelled. Noise and signal components of unequal magnitude, oppositely phased, will be attenuated through partial concellation.

In FIG. 1, means is provided by 20 for detection of signal content equal to the instantaneous magnitude (A-B) or (B-A). If one channel signal phase is inverted, by amplifier 14 for example, this difference signal may be detected by summing the currents through identical resistors from the outputs of 14 and 15. If neither or both signals are inverted by the input stages, 20 may consist of a differential amplifier.

The difference signal is applied to the input of variable gain stage 22 which provides a linear transfer characteristic up to a predetermined input amplitude and essentially constant amplitude output for higher input amplitudes by application of gain controlling feedback through voltage from signal responsive control circuit 21. The combination 22 and 21 comprise a functional equivalent to the familiar automatic gain control element found in many electronic systems. Typical methods of controlling the gain through 22 may include application of bias to diodes in shunt with the signal path or application of bias to a voltage variable resistance element such as a field effect transistor in series with the signal path, in shunt with the signal path or included in the feedback circuit of an amplifier. Alternately, gain through 22 may be varied in small discrete increments by controlled switching of resistances.

Signal responsive control 21 senses the output level from 22 and amplifies this signal as necessary and converts it to the appropriate control voltage, normally a DC potential. Preferably, the control potential is proportionate to the input signal averaged over a finite time period. This precludes abrupt gain alterations at 22 in response to transients such as may be contained in the input signal is noise "spikes".

An input signal to 22 of increasing amplitude is depicted by chart line 34. Corresponding output signal from 22 at lead 24 is depicted by chart line 37. The sense of control is such that both levels 34 and 37 increase linearly up to threshold 38 where signal responsive control 21 develops control voltage 23 to limit the output from variable gain stage 22. Beyond threshold 38 on chart line 37, the output from 22 remains essentially level as input 34 continues to increase in amplitude.

Summing circuits 16 and 17 in FIG. 1 provide means for combining the individual channel signals 18 and 19 respectively with the signal at lead 24. The sense of this function is such that for zero signal at lead 24, channel outputs at 28 and 29 are unaltered and stereo separation is maximum between the two channels A and B. If signal is present at lead 24, it will consist of $k$(A-B) or $k$(B-A) where "$k$" represents the gain through 20 and 22. Gain "$k$" is constant from zero input to difference detector 22 up to the limiting threshold where it becomes a decreasing variable. Thus, for low amplitude signals below threshold 38, "$k$" may, for example, be established by circuit constants at $\frac{1}{2}$ and for this condition the signal at lead 24 becomes, for example, $\frac{1}{2}$ B − $\frac{1}{2}$ A. Assuming signal A present at lead 18, then summing 24 and 18 at summing circuit 16, output 28 becomes A − $\frac{1}{2}$ A plus $\frac{1}{2}$ B which yields (A plus B)/2. Similarly, if summing circuit 17 contains means for subtraction or inversion and addition, the summation at 17 can be B − $\frac{1}{2}$ B plus $\frac{1}{2}$ A which also yields (A plus B)/2. For this condition, channel outputs are monaural and separation is zero db. The effect is the same as if the channels were interconnected by a short circuit. If input signals increase above threshold 38, "$k$" will be decreased by feedback control voltage 23 to hold the amplitude at 24 essentially constant. Thus, for an approximately tenfold increase in input voltage at 22 beyond threshold 38, "$k$" will be reduced to 1/20 and the summation at 16 would then be A − 1/20 A plus 1/20 B which yields 19/20 A plus 1/20 B. Similarly, under these conditions, the summation at 17 would yield 19/20 B plus 1/20 A. Channel separation for this input level is thus increased to approximately 25.5 db.

If the noise is confined to a limited portion of the input signal frequency spectrum, it is desirable that the signal at 24 in FIG. 1 be similarly restricted in frequency range. In this system, this is easily accomplished by including appropriate frequency filtering within variable gain stage 22 or between difference signal detector 20 and the input to stage 22, it being well within the skills of the art to include low pass, high pass or band-pass filtering in these signal paths. Such filtering will restrict automatic separation control to the desired frequency range only and maintain full stereo separation at other frequencies, thus preserving to a greater degree the integrity of the input program material.

Thus, it is seen that fully automatic dynamic control of separation of stereo channels is produced simply and effectively by a minimum of equipment in a single signal processing channel. For low signal levels where noise is most objectionable, noise components present in channels A and B but oppositely phased are automatically cancelled and as the difference signal level increases sufficiently to mask most of the noise, channel separation and normal stereophonic reproduction are proportionally restored automatically in an unobtrusive manner.

Figure 2:
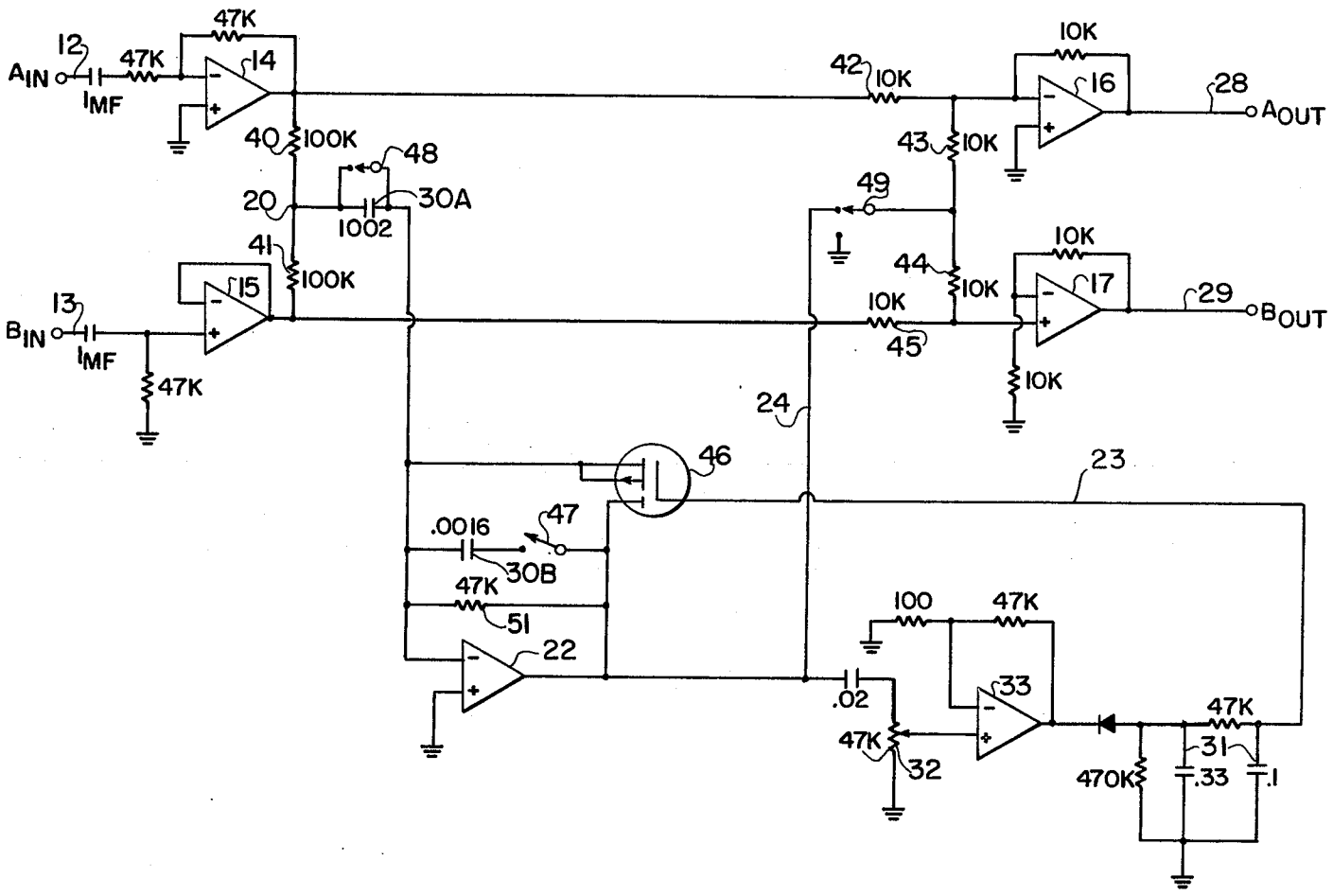
FIG. 2 is a circuit diagram partly in block of the preferred embodiment of FIG. 1.

A more detailed preferred circuit embodiment is set forth in FIG. 2, using similar reference characters as in FIG. 1 for ready comparison of circuits providing equivalent functions. Components 14, 15, 16, 17, 22 and 33 are general purpose operational amplifiers such as commercially available type 741. The general operation of this circuit is as follows:

Input buffer amplifier 14 is signal inverting unity gain with output equal to (−A). Input buffer amplifier 15 is noninverting unity gain with output (B). Stereophonic difference signal (B−A)/2 is detected at the summing junction 20 of resistors 40 and 41, the currents through which are summed at the inverting input of variable gain stage 22. The gain of stage 22 is subject to control by the voltage controlled resistance component 46 in its negative feedback loop. Resistance 51 is also in the feedback loop and determines the maximum gain of stage 22 so that its output can never exceed (A−B)/2.

Voltage controlled resistance component 46 is a field effect transistor with essentially open-circuit resistance between source and drain at zero gate bias condition and rapidly decreasing resistance when gate voltage becomes negative beyond an approximately −3 volt threshold. Bias voltage on lead 23 is developed by rectification and filtering at 31 the output from high-gain bias amplifier 33 which is in turn driven from the output of the controlled stage 22. Manual control 32 determines the input level at 33 and consequently the overall gain between 22 and the bias rectifier. The sense of control is such that very small input signals will produce small negative bias voltages at lead 23 and transistor 46 will remain open circuit so that the output from stage 22 remains (A−B)/2. As signals increase, the bias level at lead 23 increases beyond the turn-on threshold of 46 and the output of amplifier 22 is reduced to essentially the level it reached at the turn-on threshold. Thus, the transfer characteristic of 22 is linear up to the turn-on bias threshold and constant amplitude beyond. The sense of threshold control 32 is such that the maximum allowed level at lead 24 is reduced as control 32 is adjusted in the increasing gain direction.

Bias filter resistor capacitor network 31 provides a rise time of about 4.7 ms and fall time of about 175 ms, thereby providing smooth bias transitions in response to abrupt changes in signal amplitude such as from noise impulses. Rise and fall times may be easily modified to suit signal conditions by switched selection of different capacitors in 31.

The noise suppression is operative when switch 49 is switched to lead 24. Under this condition, the available signal inputs to amplifier 16 are (−A) from amplifier 14 through resistor 42 and (A−B)/N from amplifier 22 through resistor 42. These inputs are summed at the inverting input of amplifier 16 and output 28 becomes A − A/N plus B/N. At low input signal levels on the order of approximately 25 db below maximum as determined by control 32, output from 22 is maximum and output 28 is A − A/2 plus B/2, or (A plus B)/2 which is the average of the two input channel signals devoid of any oppositely phased signal components. For input sufficient to reduce the gain through stage 22, "N" becomes larger. If stage 22 gain is reduced by a factor of 5, for example, output at 28 becomes A − A/10 plus B/10, or 9/10 A plus 1/10 B. For this condition, 1/10 of the A signal has been transferred to the B channel and a like amount of the B signal transferred to the A channel with reverse phase signal components being only partially cancelled.

Inter-channel signal transfer to output 29 is similar except for alteration of signs as amplifier 17 is noninverting. Thus output 29 for low-level signals is B − B/2 plus A/2, or (A plus B)/2 which is the same as output 28. Thus for low level signals, the channel outputs are identical and are monophonic with no opposite phased components which may include noise. For higher level signals with gain through 22 reduced by a factor of 5, output 29 becomes B − B/10 plus A/10, or 9/10 B plus 1/10 A. Thus it is seen that the averaged output from the channels remains constant for monaural input signal components regardless of the degree of control of channel separation.

In FIG. 2, dynamic control of channel separation may be limited to selected portions of the available frequency spectrum by use of switches 48 and 47. With both switches open, capacitor 30A appears in the current path to the input of amplifier 22 so that the signal at lead 24 will be restricted to the range above approximately 1500 hz. For this condition, outputs 28 and 29 remain stereophonic for frequencies below approximately 1500 hz and dynamic separation control will affect only frequencies above approximately 1500 hz such as might be suitable for noise reduction from FM stereo where high frequency hiss is the dominate noise component. With both switch 48 and switch 47 closed the signal at lead 24 is restricted by feedback capacitor 30B to the range below approximately 2000 hz and dynamic separation control will affect only this range. This condition might be more suitable to noise reduction from stereo phonograph sources where a large proportion of noise derives from vertical stylus motion induced by record surface flaws and turntable rumble. For broad-band signals at lead 24, switch 48 is closed and switch 47 is open.

In this circuit configuration, low distortion outputs will be provided for all signal control conditions for input levels up to about 2.5 or 3 volts rms, which is well above the output from typical phonograph preamplifiers and FM stereo tuners. Power supply requirements are positive and negative 12 to 15 volts at approximately 12 ma. Operation is simple and ready comparison may be made by switching the suppression function in or out with switch 49 during adjustment. Typically, control 32 is set for monophonic outputs up to about 25 - 30 db below maximum input levels. For this condition, a large proportion of objectionable noise components are suppressed dynamically as a function of stereo signal characteristics, without any readily observable loss of the stereophonic effect, and without any switching clicks or other audible transitions between mono and stereo.

It is evident therefore that the invention has provided improved noise suppression circuits for stereophonic systems and the appended claims define with particularity those novel features believed descriptive of the spirit and nature of the invention.

What is claimed is:

1. In a stereophonic reproduction system, the combination comprising, two separate reproduction channels for providing stereophonic output signals A and B from two separate input signal sources, third channel means for deriving the difference signal (A-B) between the two input channels, variable gain means including control means for varying the magnitude of the difference signal to provide a linear transfer characteristic up to a predetermined input amplitude and essentially constant amplitude for input amplitudes higher than the predetermined input amplitude, signal responsive control means operable with said variable gain means to control the gain by feedback path from the output of said variable gain means, and means summing the output of said variable gain means into each of said two reproduction channels in proper phase that the signal in each channel respectively is reduced in the same proportion as the signal from the opposite channel is added, thereby to provide two output signal channels in which oppositely phased signal content for amplitudes below said predetermined input amplitude is reduced as a function of the difference signal A-B, and wherein the averaged output from channels A and B remains constant for monaural input signal components regardless of the degree of control by the third channel.

2. The system defined in claim 1 connected to a phonograph having a record with grooves modulated laterally with monophonic recordings and vertically with stereophonic recordings, wherein the transfer means interconnects the two channels to cancel out the vertically modulated recording component at amplitudes below a predetermined threshold.

3. The system defined in claim 1 including switching means selectively introducing impedance means into said signal responsive control means for providing different response of said system to selected frequency bands.

4. A system as defined in claim 1 including means deriving the difference signal A-B comprising a resistive net-work coupled between channels A and B.

5. A system as defined in claim 1 including filter means selectively altering the bandwidth of the derived difference signal A-B.

6. A system as defined in claim 1 wherein said signal responsive control means comprises a circuit deriving a direct current control voltage proportional to the magnitude of the difference signal output from said variable gain means.

7. A system as defined in claim 6 including a voltage variable resistance element included in the feedback path.

8. A system as defined in claim 7 wherein the resistance element comprises a field effect transistor.

9. A system as defined in claim 1 including manual control means setting said predetermined input amplitude.

10. A system as defined in claim 1 wherein the means for deriving the difference signal consists of a differential amplifier.

* * * * *